US008439642B2

(12) United States Patent
Scott et al.

(10) Patent No.: US 8,439,642 B2
(45) Date of Patent: May 14, 2013

(54) PUMP AND PUMP IMPELLER

(75) Inventors: Thomas M. Scott, Lucas, OH (US); Eddie D. Cottrell, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 631 days.

(21) Appl. No.: 12/601,629

(22) PCT Filed: May 30, 2008

(86) PCT No.: PCT/US2008/006880

§ 371 (c)(1), (2), (4) Date: Nov. 24, 2009

(87) PCT Pub. No.: WO2008/150464

PCT Pub. Date: Dec. 11, 2008

(65) Prior Publication Data

US 2010/0172751 A1 Jul. 8, 2010

Related U.S. Application Data

(60) Provisional application No. 60/932,692, filed on Jun. 1, 2007.

(51) Int. Cl.
*F04D 29/30* (2006.01)

(52) U.S. Cl.
USPC ..... 416/183; 415/206; 416/228

(58) Field of Classification Search ..... 415/206; 416/183, 185, 228
See application file for complete search history.

(56) References Cited

U.S. PATENT DOCUMENTS

| | | | | |
|---|---|---|---|---|
| 1,688,345 | A * | 10/1928 | Mursch et al. | 416/183 |
| 3,713,749 | A * | 1/1973 | Fitch | 415/200 |
| 3,898,014 | A | 8/1975 | Meister et al. | |
| 4,066,382 | A | 1/1978 | Lakin et al. | |
| 4,676,718 | A | 6/1987 | Sarvanne | |
| 5,385,447 | A | 1/1995 | Geister | |
| 6,074,167 | A | 6/2000 | Olifirov et al. | |
| 6,280,493 | B1 * | 8/2001 | Eubank | 55/398 |
| 6,406,255 | B1 * | 6/2002 | Angelle | 415/121.1 |
| 6,638,020 | B1 * | 10/2003 | Tsui | 416/185 |
| 6,887,034 | B2 | 5/2005 | Mesiter et al. | |
| 7,114,925 | B2 * | 10/2006 | Shaw | 416/185 |

OTHER PUBLICATIONS

PCT/US2008/006880 International Search Report and Written Opinion; date of mailing Sep. 22, 2008.
Interntational Search Report PCT/US2008/006880, Sep. 2008.

* cited by examiner

*Primary Examiner* — Edward Look
*Assistant Examiner* — Liam McDowell
(74) *Attorney, Agent, or Firm* — Tarolli, Sundheim, Covell & Tummino LLP

(57) ABSTRACT

A pump assembly that includes a pump housing defining an inlet for receiving fluid to be pumped and an outlet for discharging fluid. A rotatable impeller operatively coupled to a drive motor includes a plurality of vane structures integrally formed with a shroud. Each vane structure includes a curved, axial vane segment extending axially from the shroud. A compound, multi-step auxiliary vane extends transversely from each axial vane segment. The auxiliary vane or wing includes at least first and second sections, with the second section overlying the first section in a staggered configuration such that the trailing edges of the first and second sections are spaced apart to form a step. The second auxiliary vane section includes an axial surface that also forms a working vane surface for the auxiliary vane.

11 Claims, 6 Drawing Sheets

PUMP AND PUMP IMPELLER

TECHNICAL FIELD

The present invention relates generally to the pumping of fluids containing solids and, in particular, to a pump impeller which improves the efficiency of a solids handling pump.

BACKGROUND ART

Pumps capable of handling fluids such as water that includes solids are known in the prior art. One type of pump that is capable of handling solids is termed a "vortex" pump. An example of such a pump is disclosed in U.S. Pat. No. 4,676,718. Centrifugal pumps such as disclosed in U.S. Pat. Nos. 3,898,014 and 6,887,034, which are hereby incorporated by reference, are also capable of handling solids in waste water pumping applications.

Pumps capable of passing relatively large solids, such as vortex pumps, characteristically have high flow rates at low head pressures. In the marketplace, it has been found that it is desirable to have pumps that can operate at higher head pressures at low flow rates, without sacrificing solids handling capability. Attempts at designing and making pumps capable of producing higher head pressures at low flow rates have been made. It has been found however, in some applications, that these types of pumps tend to require larger size motors to prevent overloading the motor in a high flow application.

DISCLOSURE OF INVENTION

The present invention provides a new and improved pump and pump impeller. When used in a vortex-type pump, the impeller improves overall efficiency of the pump without compromising its solids handling capability.

According to the invention, the pump assembly includes an impeller that improves the overall efficiency of the pump. According to the preferred embodiment, the impeller includes two or more vanes extending from a shroud. Each vane comprises an axial extending segment which is preferably curved. Extending transversely from each axial vane segment is a stepped wing or auxiliary vane. The auxiliary vane includes first and second sections which may have stepped leading edges and/or stepped trailing edges.

In the illustrated embodiment, a first wing section extends transversely from a top edge of its associated axial wing segment. The first wing section includes an inner end that is preferably spaced radially outwardly with respect to an inner end of its associated axial wing segment. A second wing section extends from the first wing section and in one embodiment, a step is defined between the trailing edges of the first and second sections. In a more preferred embodiment, a step is also defined between the leading edges of the first and second sections.

According to the invention, an inner end of the second wing section is spaced radially outwardly from the inner end of the first section. This stepped configuration enlarges the eye of the pump and decreases the pump's net positive suction head required (NPSHR), thus allowing the pump to maintain higher flow rates.

In the preferred and illustrated embodiment, the auxiliary wing widens as one proceeds from the inner end to the outer periphery. This construction tends to create an overhang over a flow passage that is defined between adjacent axial vane segments With the disclosed impeller construction, the pump is capable of producing higher head pressures at lower flow rates while having the ability to handle relatively large solids.

Additional features of the invention will become apparent and a fuller understanding obtained by reading the following detailed description made in connection with the accompanying drawings.

BEST MODE FOR CARRYING OUT THE INVENTION

Figure 1:
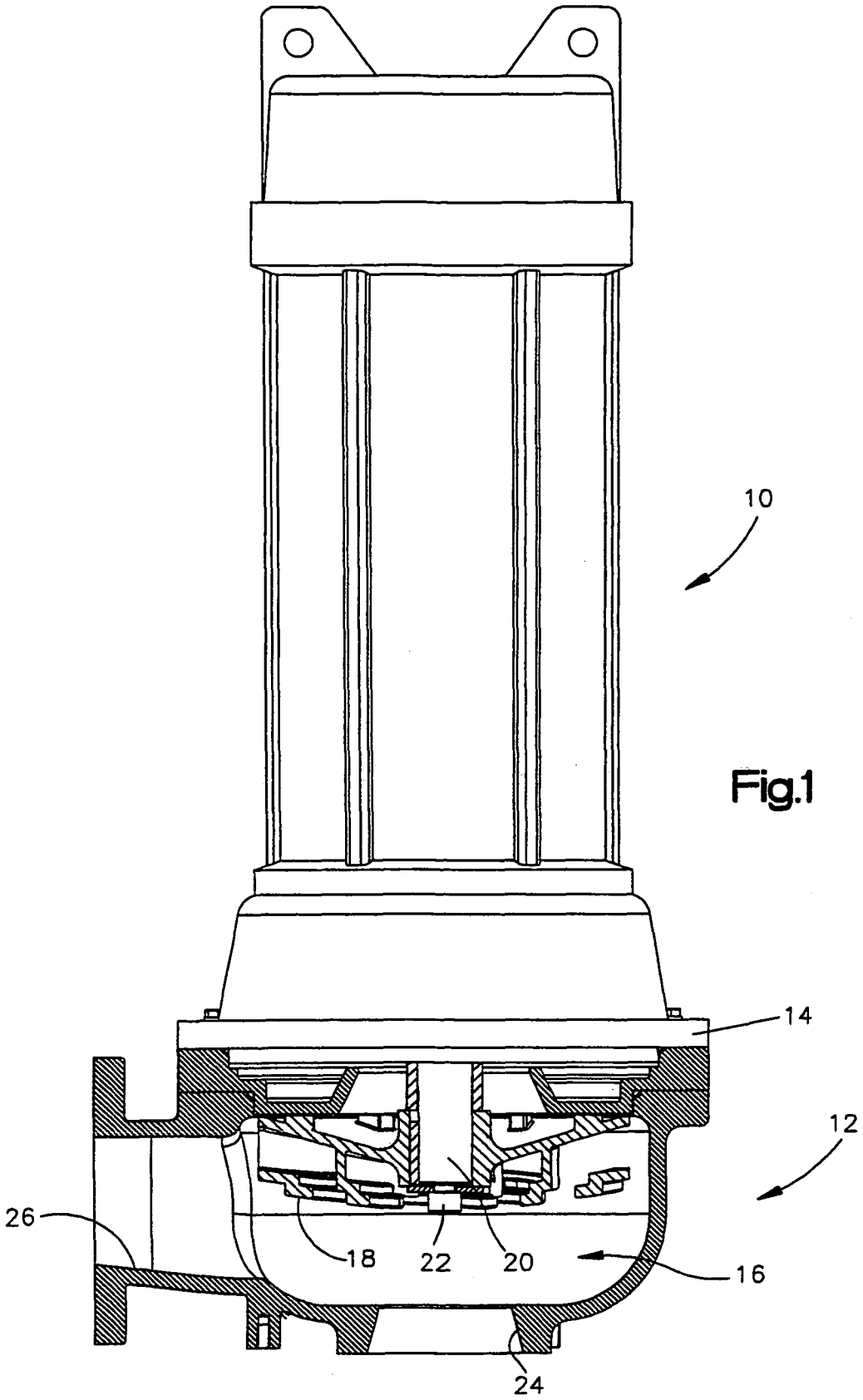
FIG. 1 is a side elevational view, partially in section, of a pump assembly constructed in accordance with a preferred embodiment of the invention.

FIG. 1 illustrates the overall construction of a pump assembly constructed in accordance with a preferred embodiment of the invention. The illustrated pump would be termed a vortex pump. The principles of the invention, however, are applicable to straight centrifugal pumps and self-priming pumps.

The illustrated pump assembly includes a drive motor indicated generally by the reference character 10 which may comprise an electric motor, a hydraulic motor, an internal combustion engine or combinations thereof. A pump casing indicated generally by the reference character 12 is attached to a motor housing flange 14 by suitable fasteners. The pump casing 12 defines a chamber 16 in which an impeller 18 constructed in accordance with the preferred embodiment of the invention is rotated. The pump impeller 18 is operatively coupled to a rotatable drive shaft 20 which, in the illustrated embodiment, is part of the drive motor assembly 10. It should be noted here that the invention is applicable to pedestal type pumps i.e. a pump that includes an impeller attached to a drive shaft rotatably supported in a pedestal housing (see FIG. 10). The drive shaft is in turn coupled to a pump drive motor via a drive chain or belt.

As seen in FIG. 1, a lower end of the drive shaft 20 extends into the chamber 16. The impeller 18 is removably attached to the lower end (as viewed in FIG. 1) of the drive shaft 20 and is secured thereto by a suitable fastener such as a bolt. 22

The pump casing 12 also defines an axial inlet 24 that communicates with the chamber 16 and a radial outlet. 26 In operation, rotation of the impeller 18 causes pumpage to be drawn into the chamber 16 via the axial inlet 24. The pumpage is discharged from the chamber 16 by way of the radial outlet 26.

Figure 2:
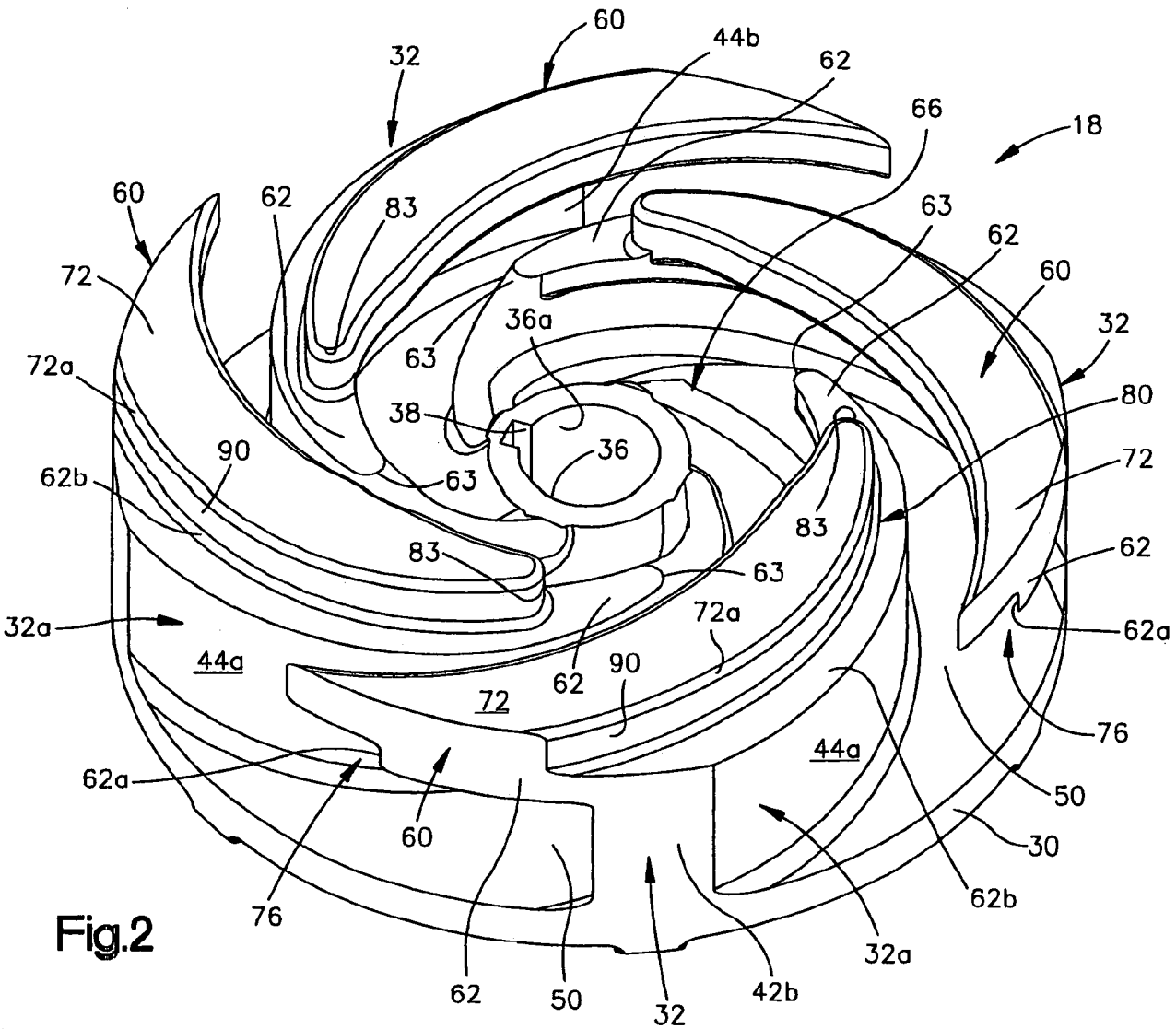
FIG. 2 is a perspective view of an impeller constructed according to one preferred embodiment of the invention and which may form part of the pump assembly shown in FIG. 1.

FIG. 2 illustrates the overall construction of an impeller 18 constructed in accordance with one preferred embodiment of the invention. The impeller 18 includes a circular, planar shroud 30 and a plurality of vanes indicated generally by the reference character 32, portions of which extend axially (downwardly as viewed in FIG. 1) from the shroud 30. In the illustrated embodiment, the impeller includes four vanes but the invention contemplates impellers with two or more vanes.

Figure 3:
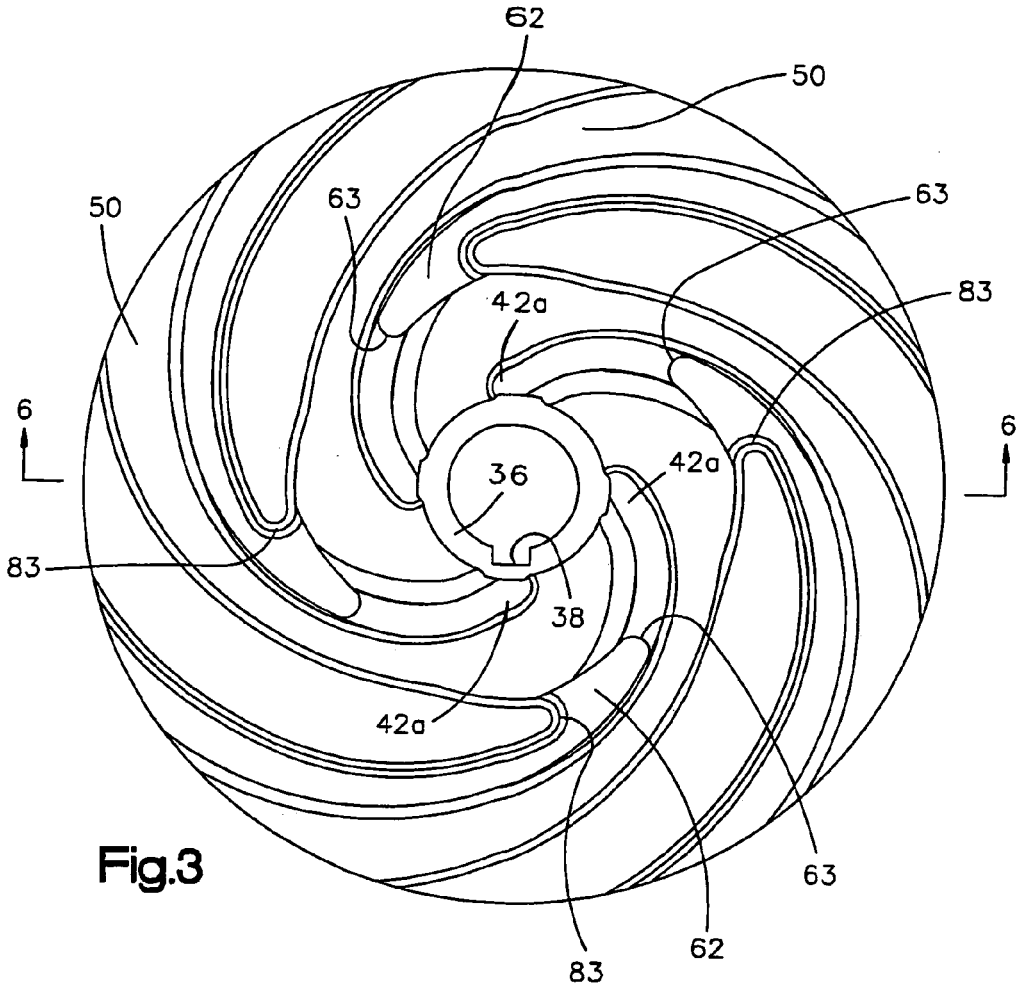
FIG. 3 is a plan view of the impeller shown in FIG. 2.

As seen in FIGS. 2 and 3, the impeller 18 includes a centrally positioned hub by which the impeller is attached to a motor drive shaft 20, which, in turn, defines an axis of rotation for the impeller. The hub is preferably keyed. The hub 36 includes a bore 36*a* that is sized to closely match the diameter of the shaft 20. When mounted, a key (not shown) is held in a hub keyway 38 and a companion keyway (not shown) formed in the drive shaft 20. The key inhibits relative rotation between the impeller 18 and the drive shaft 20. A suitable fastener such as a bolt 22 (shown in FIG. 1) or nut maintains the impeller 18 on the drive shaft 20.

Figure 5:
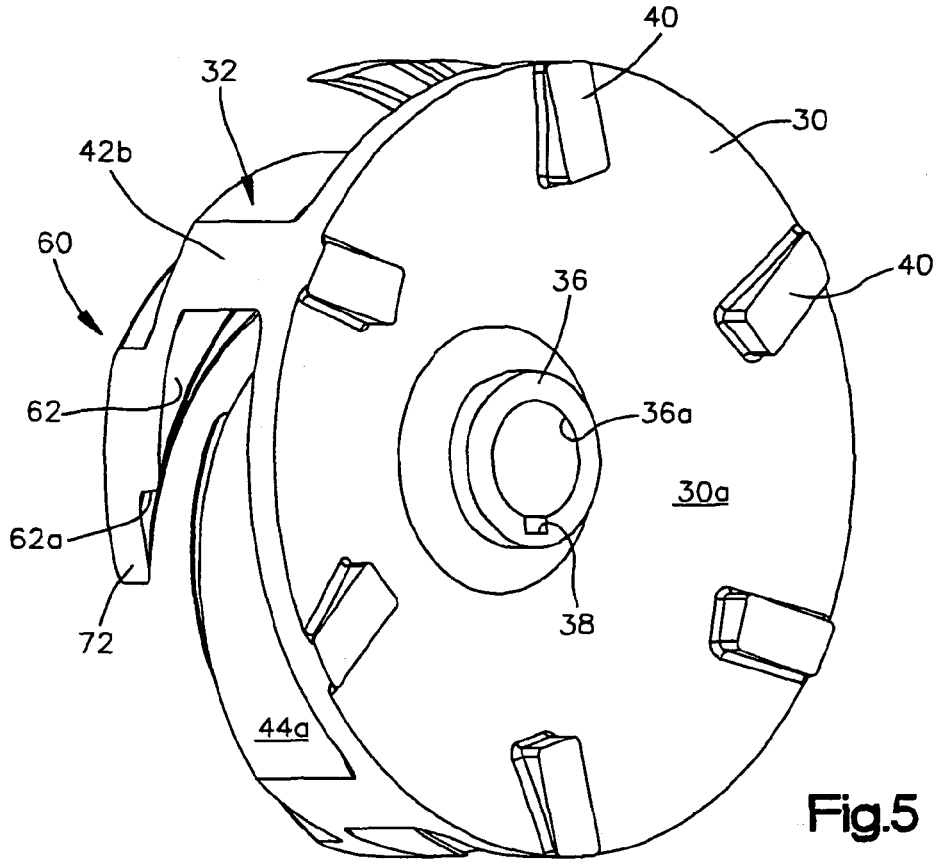
FIG. 5 is another perspective view of the impeller shown in FIG. 2, rotated to show an underside of the impeller.
Figure 6:
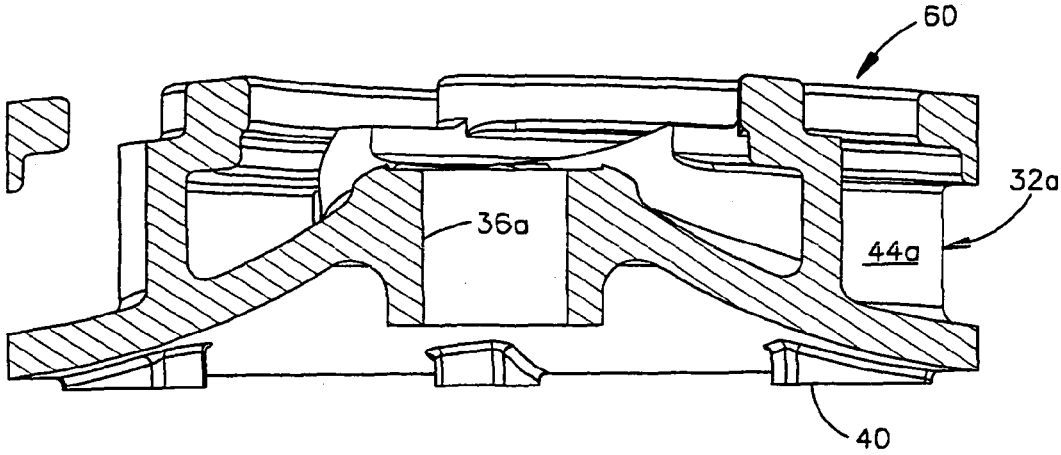
FIG. 6 is a sectional view of the impeller as seen from the plane indicated by the line 6-6 in FIG. 3.

Referring to FIG. 5, an underside 30*a* (the side opposite the side from which the vanes 32 extend) of the shroud 30 defines a plurality of pump-out vanes 40 spaced around the periphery of the inside surface 30*a* of the shroud. The vanes are generally radially oriented, but are offset at an angle with respect to a radius line of the shroud. (Other shapes for the pump out vanes are contemplated.) In operation, the pump-out vanes 40 urge fluid between the underside of the shroud and the pump casing, outwardly.

Figure 4:
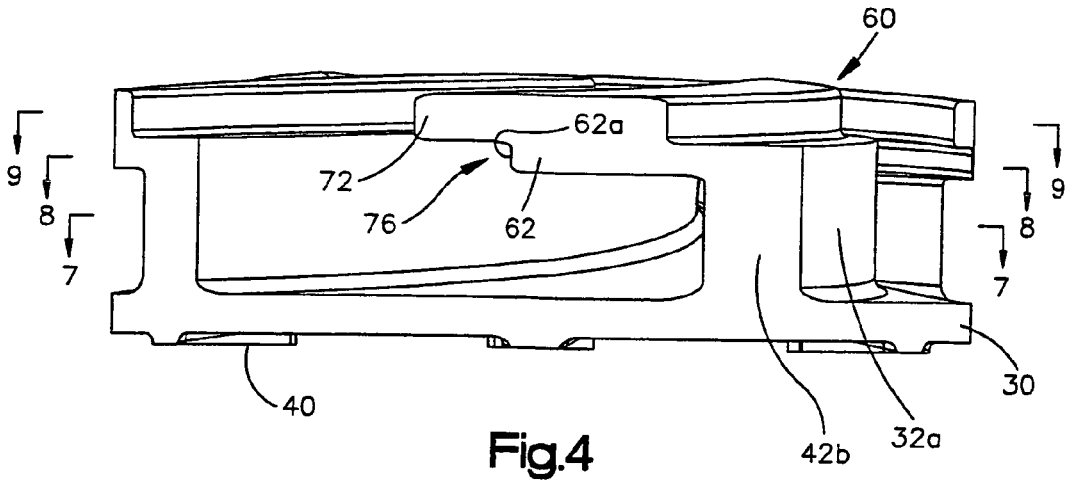
FIG. 4 is a side elevational view of the impeller.

Referring in particular to FIGS. 2-4, the illustrated impeller includes four equally spaced vanes, each designated by the reference character 32. Each vane 32 includes an axially extending segment 32*a* that extends from an inner end 42*a* (FIG. 3) located near the hub 36 and a peripheral end 42*b* (FIG. 2) that terminates at the periphery of the shroud 30. Each vane segment 32*a* is preferably curved and defines a working side 44*a* and an inner, non-working side 44*b*.

Figure 7:
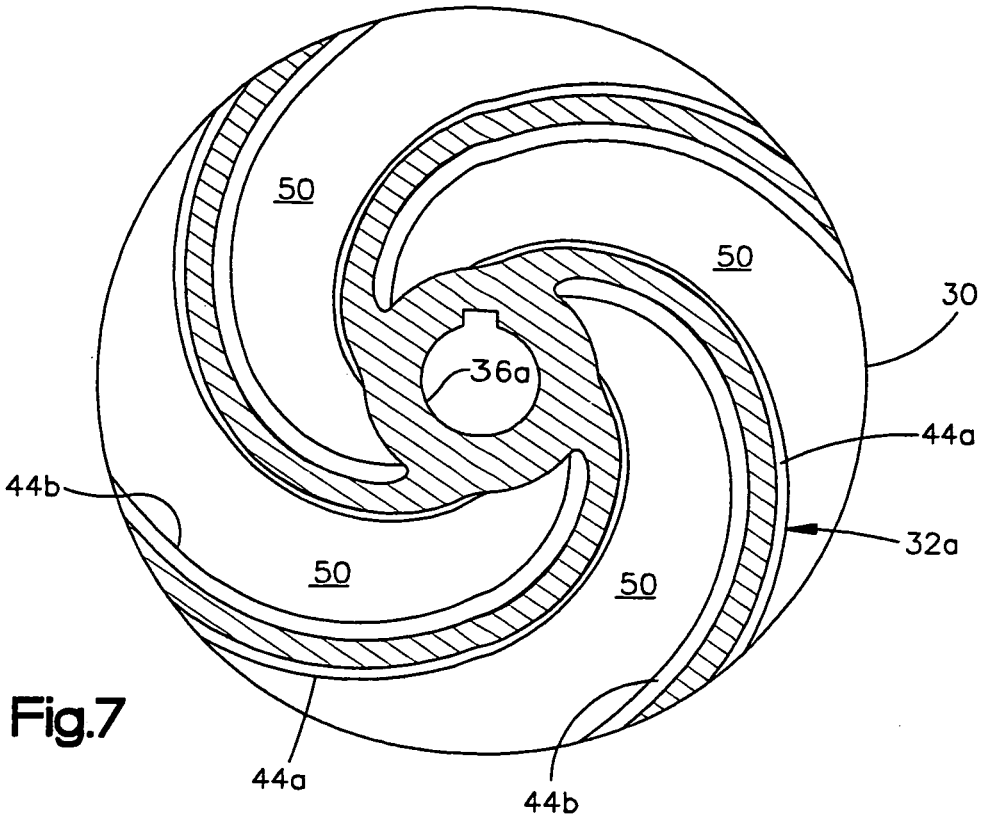
FIG. 7 is a sectional view of the impeller as seen from the plane indicated by the line 7-7 in FIG. 4.
Figure 8:
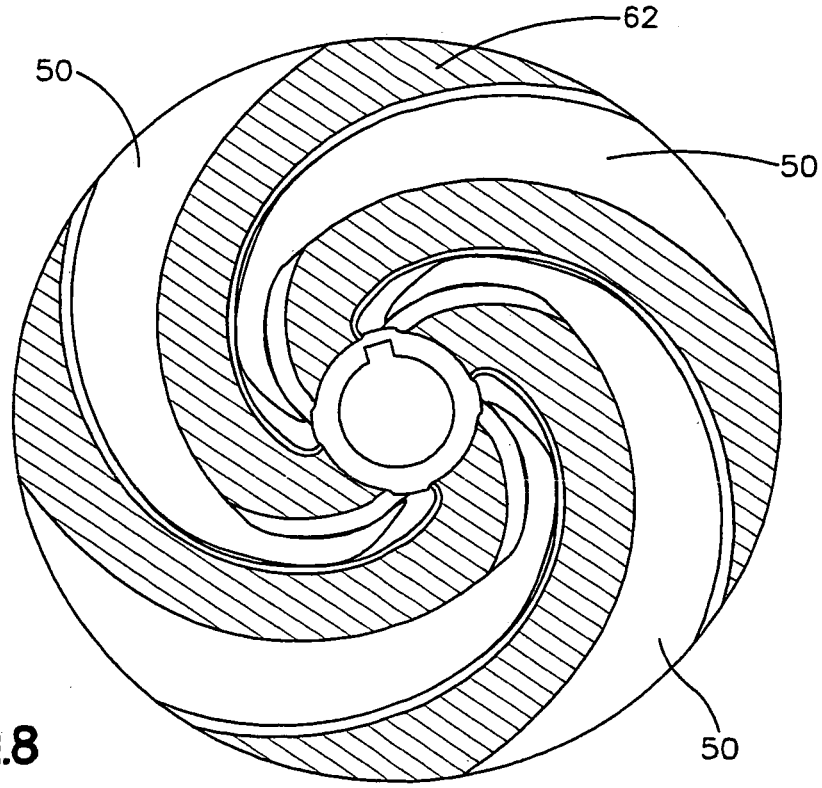
FIG. 8 is a sectional view of the impeller as seen from the plane indicated by the line 8-8 in FIG. 4.
Figure 9:
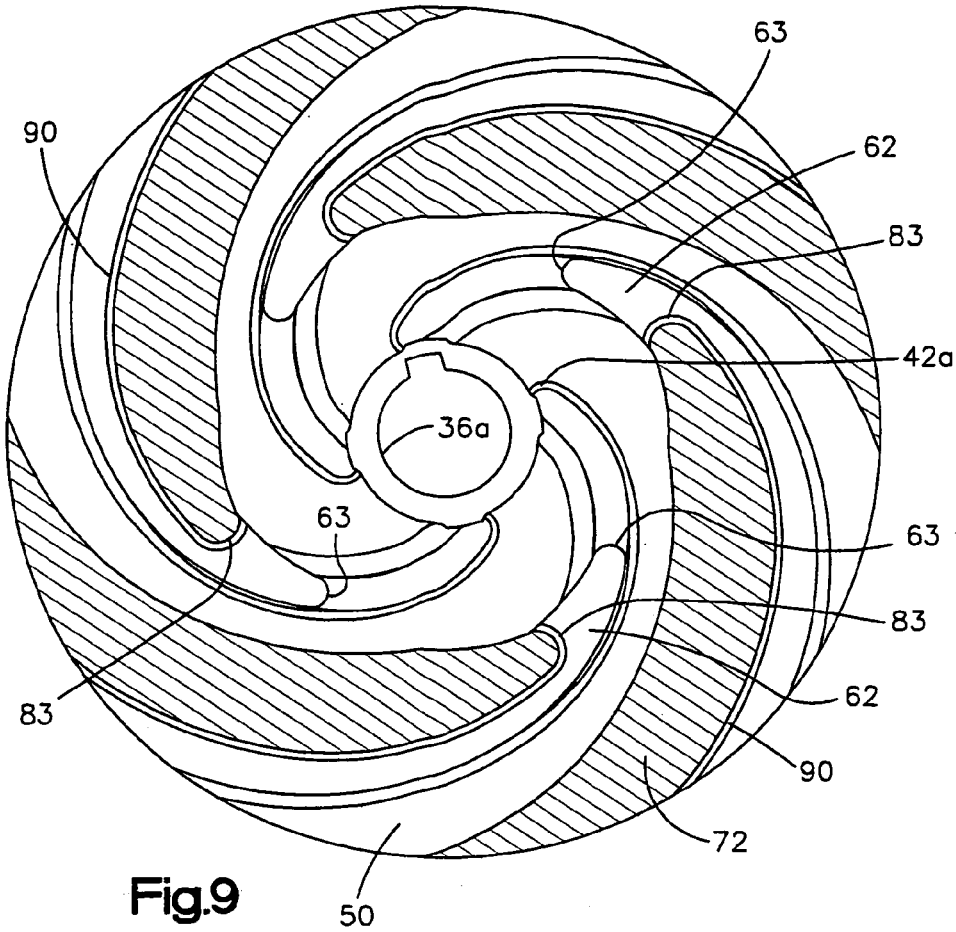
FIG. 9 is a sectional view of the impeller as seen from the plane indicated by the line 9-9 in FIG. 4.

As seen best in FIG. 7, a plurality of curved flow passages 50 are defined between the working side 44*a* of one vane and the inside, non-working side 44*b* of an adjacent vane. In operation, rotation of the impeller causes fluid in the flow passages to be urged outwardly due to centrifugal force.

According to the invention and referring to FIG. 2, each vane 32 includes a transversely extending auxiliary vane or wing 60 having a stepped configuration. In the preferred and illustrated embodiment, each wing 60 includes a first section or segment 62 which extends transversely from an upper edge of the axial vane segment 32*a*. Preferably, the first segment 62 terminates short of the inner end 42*a* (see FIG. 3) of the axial vane segment 32*a* and also has a transverse dimension that widens as one proceeds from an eye region 66 of the impeller 18 (shown in FIG. 2) to the outer periphery of the impeller. The invention does contemplate a construction in which the first segment section 62 of the wing 60 has an inner end 63 that terminates substantially coincident with the inner end 42*a* of the vertical vane segment 32*a*. However, it is believed that by spacing the inner end 63 of the first wing segment 62 from an inner end of the vertical vane segment (shown best in FIG. 3), the pump's NPSHR is reduced.

According to the invention, a second transverse section 72 of the wing 60 extends beyond a terminating edge 62*a* of the first section 62. In effect, a stairstep configuration between the first and second sections 62, 72 is defined and is indicated generally by the reference character 76. In the preferred and illustrated embodiment, a leading or working edge 72*a* of the second wing section 72 is also spaced from the working side 44*a* of the associated axial vane segment 32*a* so that a stairstep configuration indicated generally by the reference character 80 is defined between the first and second wing sections 62, 72. According to the preferred embodiment, the second wing 72 section has an inner end 83 that is spaced radially outward from the inner end 63 of the first wing section 62. It is believed that this relationship further reduces the pump's NPSHR.

As seen best in FIG. 2, the stepped wings 60 that extend transversely from the upper end (as viewed in FIG. 2) of the axial vane segments 32*a* tend to overlie and partially enclose the flow passages 50 defined between adjacent vane segments 32*a*. It is believed that this overlying configuration tends to improve pump efficiency while not adversely affecting the pump's NPSHR.

In the illustrated embodiment, the stepped wings 60 extend from the trailing/non-working side 44*b* of each vane segment 32*a*. The present invention contemplates similarly configured wings or secondary vanes that extend transversely from the working side 44*a* of each vane as well as constructions in which a leading edge of the wing extends beyond the working side of a vane and the trailing portion of the wing extends beyond the non-working side of the vane.

In the illustrated embodiment, the second wing section 72 defines an axially extending surface 90 which in effect defines the working side of an auxiliary vane section. The present invention also contemplates constructions in which the leading edge 72*a* of the second wing segment 72 is aligned with the working side 44*a* of the axial vane segment 32*a*. In this latter construction, a step would not be defined between the second section 62 and first section 72 of the wings. The present invention also contemplates surfaces 72*a*, 44*a* having identical contours, partially aligned contours or contours that are not aligned at any point.

It should be noted here, that in the illustrated embodiment, a wing or auxiliary vane having first and second sections 62, 72 is illustrated. The invention, however, contemplates wings with two or more wing sections that may include stepped trailing edges and stepped leading edges. The present invention also contemplates constructions in which either the leading edges or the trailing edges of the wing sections are stepped but not both.

In the preferred embodiment, the inner ends 63, 83 of the first and second wing sections 62, 72, respectively do not extend into a co-extensive relationship with the inner ends 42*a* of the vertical vane segments. By using a stepped spacing of the inner ends of the wing sections, the "eye" 66 (FIG. 2) of the pump is enlarged which decreases the pump's NPSHR.

Figure 10:
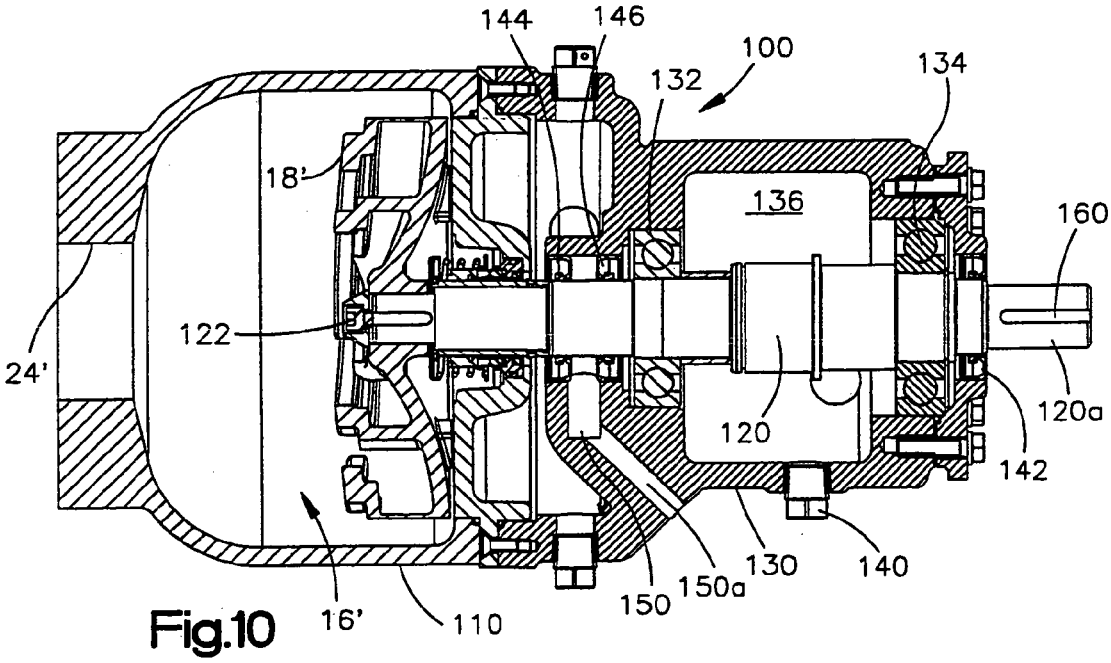
FIG. 10 is a sectional view of a pedestal-type pump constructed in accordance with another preferred embodiment of the invention.

Referring to FIG. 10, the invention is shown as part of a pedestal-type pump 100. The pedestal pump 100 includes a casing 110 which defines an impeller chamber 16' in which an impeller 18' rotates. Rotation of the impeller 18' draws fluid from an axial inlet 24' and conveys the fluid under pressure to an outlet (not shown).

The impeller 18' is removably attached to a drive shaft 120 by means of a fastener 122. The drive shaft is rotatably supported within a pedestal housing 130 by a pair of ball bearings 132, 134. In the illustrated embodiment, the pedestal housing 130 defines a lubricating chamber 136 which can be filled with lubricant by removing the fill plug 140. The upper end of the shaft is sealed to the housing 130 by a lip seal 142. The lower end of the drive shaft 122 is sealed by a pair of spaced-apart lip seals 144, 146. If either pumpage or lubricant leaks past the lip seals 144, 146, this leakage is manifested by the presence of leakage in the cavity 150 defined between the seals 144 and 146 and the vent passage 150*a*.

As is known, the upper end 120*a* of the drive shaft 120 is connected to a suitable drive motor. For example, a drive pulley or chain sprocket (not shown) may be secured to the upper end 120*a* of the drive shaft. The pulley or sprocket would, in turn, be connected to a drive motor via a drive belt or chain. Alternately, a coupling can be mounted to the drive shaft end 120*a* and be directed coupled to a drive motor such as an internal combustion engine. In the illustrated embodiment, the drive shaft end 120*a* includes a keyway 160 to facilitate coupling of the drive shaft to the drive source.

The impeller construction has been disclosed in connection with a vortex pump. It should be understood that the disclosed impeller and its principles of operation can be applied to centrifugal and self-priming pumps or other types of pumps that include a wear plate located adjacent the impeller.

Although the invention has been described with a certain degree of particularity, it should be understood that those skilled in the art can make various changes to it without departing from the spirit or the scope of the invention as hereinafter claimed.

The invention claimed is:

1. A pump assembly, comprising:

a) pump casing defining a chamber;

b) an impeller rotatable within said chamber for urging fluid from an inlet to an outlet;

c) a drive motor for rotating said impeller;

d) said impeller including a plurality of vanes, each vane including:

i) an axial vane segment extending from a shroud;

ii) a stepped auxiliary vane including first and second wing sections, both of said first and second wing sections extending in a substantially same transverse direction with respect to said axial vane segment;

iii) one of said first and second wing sections at least partially overlying another of said first and second wing sections.

2. The pump assembly of claim 1 wherein there is a stepped transition between trailing edges of said first and second wing sections.

3. The pump assembly of claim 1 wherein said transversely extending first and second wing sections tend to at least partially overlie associated flow passages defined between adjacent axial vane segments.

4. The pump assembly of claim 1 wherein said first and second wing sections have first and second inner ends that are spaced radially outwardly with respect to an inner end of an associated axial vane segment.

5. The pump assembly of claim 1 wherein each of said first and second wing sections has an increasing transverse dimension as one proceeds from an inner end to a peripheral end.

6. The pump assembly of claim 1 wherein said axial vane segment is curved.

7. The pump assembly of claim 1 further comprising a pedestal housing for rotatably supporting a drive shaft to which said impeller is attached and further comprising a coupling device for coupling said drive motor to said drive shaft.

8. A pump assembly, comprising:

a) a pump housing defining an inlet for receiving fluid and an outlet for discharging fluid;

b) a rotatable impeller for urging fluid received from said inlet to said outlet;

c) a drive motor assembly for rotating said impeller, said drive motor assembly including a drive shaft operatively connected to said impeller;

d) said impeller including a plurality of vane structures integrally formed with a shroud;

e) each vane structure including:

i) a curved, axial vane segment extending axially from said shroud;

ii) a compound, auxiliary vane extending transversely from said axial vane segment;

iii) each compound auxiliary vane including at least first and second sections extending in a substantially same transverse direction, said second section overlying said first section in a staggered configuration such that trailing edges of said first and second sections are spaced apart whereby a step is formed;

iv) said second auxiliary vane section including an axial surface extending axially from a leading edge of said second section toward said first section whereby a working vane surface is defined;

v) each of said first and second sections having an increasing transverse dimension as measured from an inner end of each section to an outer peripheral edge; and vi) said first and second sections having radially spaced apart inner ends.

9. The pump assembly of claim 8 wherein curved flow passages are defined between adjacent vertical vane segments and said auxiliary vanes at least partially overlying associated flow passages.

10. The pump assembly of claim 8 wherein said impeller further includes hub structure by which said impeller is attached to said drive shaft and said vertical vane segments have inner ends located near said hub structure.

11. The pump assembly of claim 10 wherein said inner ends of said vertical vane segments are spaced radially inwardly with respect to inner ends of said first and second sections.

* * * * *